United States Patent [19]

Mahon et al.

[11] Patent Number: 4,923,086

[45] Date of Patent: May 8, 1990

[54] ICE GUARDS

[75] Inventors: Terrence K. Mahon, Milwaukee; Daniel A. Matre, Wauwatosa, both of Wis.

[73] Assignee: The Vollrath Company, Inc., Sheboygan, Wis.

[21] Appl. No.: 298,415

[22] Filed: Jan. 18, 1989

[51] Int. Cl.[5] ..... B65D 81/24

[52] U.S. Cl. ..... 220/401; 62/371; 62/457.6; 220/413

[58] Field of Search ..... 62/258, 246, 457.1, 62/457.6, 458, 459, 463, 371, 372; 220/400–413; 312/116, 236, 284, 285

[56] References Cited

U.S. PATENT DOCUMENTS

| | | | |
|---|---|---|---|
| D. 288,053 | 2/1987 | Maze et al. | D7/58 |
| 1,186,418 | 6/1916 | Mischo | 62/459 |
| 1,771,883 | 7/1930 | Emig et al. | 220/412 |
| 2,052,726 | 9/1936 | Schleier | 220/412 |
| 2,122,317 | 6/1938 | Hanson | 220/410 |
| 2,168,969 | 8/1939 | Bickerstaff | 62/457.6 |
| 2,194,719 | 3/1940 | Parrish | 220/412 |
| 2,239,484 | 4/1941 | Cocks | 220/412 |
| 2,627,824 | 2/1953 | Schulze | 220/401 |
| 2,838,916 | 6/1958 | Sola | 62/77 |
| 4,005,586 | 2/1977 | Lyons | 62/372 |
| 4,175,921 | 11/1979 | Southern et al. | 220/408 |
| 4,347,713 | 9/1982 | Morrison et al. | 62/371 |
| 4,494,654 | 1/1985 | Gunther et al. | 206/562 |
| 4,572,598 | 2/1986 | Moore, Jr. | 312/284 |
| 4,782,665 | 11/1988 | Wolfe | 312/284 |

OTHER PUBLICATIONS

Continental, Catalogue of unknown date showing ice guards.

Rubbermaid, Catalogue of unknown date showing crock inserts.

Silite, Catalogue of unknown data showing ice cylinders.

*Primary Examiner*—Jimmy G. Foster

*Attorney, Agent, or Firm*—Olson & Hierl

[57] ABSTRACT

An ice guard to receive a food container in crushed, flaked, cubed, or broken ice is provided having a side wall which includes a first end and a second end. The first end receives a first size of food container. The second end includes an inwardly intruding rim which receives a second, smaller size of food container. The side wall can define a plurality of apertures to cool the food container. By simply inverting the ice guard, different size food containers can be accommodated.

16 Claims, 2 Drawing Sheets

ICE GUARDS

FIELD OF THE INVENTION

The present invention relates to ice guards used with salad bars and in particular to salad bar food containers.

BACKGROUND OF THE INVENTION

The use of self-serve salad bars has in recent years proliferated. While originally found only in sit-down family style restaurants, self-serve salad bars have expanded to convenience restaurants such as fast food establishments and truck stops. The self-serve salad bars can even be found in grocery stores and supermarkets near urban populations where young urban professionals carry the self-created salads home for consumption.

The popularity of salad has posed two distinct problems for dining establishments which offer such service. The resultant increase in volume at the salad bars has created a greater burden on the dining establishments to supply fresh food items. It is not unusual for an establishment to have at least one employee assigned full-time to the task of replenishing the salad bar.

The popularity has also resulted in a large number of customers crowded around the salad bars at peak hours. This makes it increasingly difficult to replenish the salad bar as access is difficult to obtain.

In salad bars, typically, the food has been offered in food containers which are placed in a pile of crushed, flaked, cubed or broken ice. The ice level typically approaches the top of the food container in order to maintain the food container and therefor the food at a cool temperature.

A problem in replenishing food items in the typical salad bar is that when the food container is removed so that a full container can take its place, the crushed, flaked, cubed or broken ice quickly fills the void left by the removed container, and the replenished container must be squeezed into the ice. This considerably slows the process of replenishing the food items.

To alleviate this problem, screens have been employed which hold back the ice to reserve a space in the ice for replenished food containers. The problem with the use of such screens is that they are quite nonversitile in that each size food container requires a different size screen and food containers of different heights end up being displayed at different heights.

What is thus needed is a device which helps organize the large number of food items offered to salad bar customers and helps make refilling of food containers both quick and easy. The device would also be versatile in use and inexpensive to produce. The present invention provides such a device.

SUMMARY OF THE INVENTION

The present invention provides a device which reserves a place for food containers in crushed, flaked, cubed or broken ice. A side wall having a first end and a second end and defining an interior space is provided. The first end defines an opening adapted to receive a first size of food container through the first opening and into the interior space. The second end of the side wall includes a rim mounted thereon and extending inwardly of the side wall. The rim defines a second opening adapted to receive a second, smaller, size of food container. In use, the device can be inverted to accommodate different size food containers. The side wall can include a plurality of apertures to allow the ice to cool the food containers.

The present device thus helps to organize a salad bar by providing a quick easy means for replacing empty food containers. The device is also versatile in that it can accommodate different size and heights of food containers by simple inversion. This reduces the inventory a restaurant must maintain to handle different sizes of food containers.

DETAILED DESCRIPTION OF A PREFERRED EMBODIMENT

Figure 1:
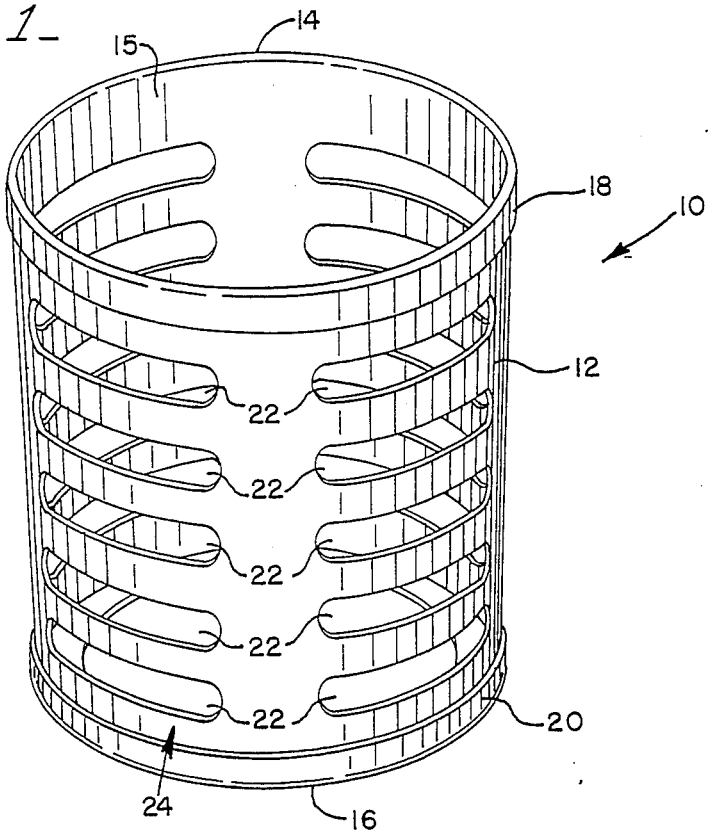
FIG. 1 is a perspective view of a preferred embodiment of a device in accordance with the present invention.

Referring to FIG. 1, a device in accordance with the present invention is designated generally by the reference number 10. The device can be referred to as an ice guard, and such name will be used herein.

The ice guard 10 includes a side wall 12 which defines a first end 14 and a second end 16. The first end 14 defines a first opening 15 while the second end 16 defines a second opening 17. The ice guard 10 is adapted to receive a food container used to store food items in a salad bar. In this vein, the side wall 12 has a tapered shape. This helps receive the food containers and increases the ease in molding the ice guard 10.

Figure 2:
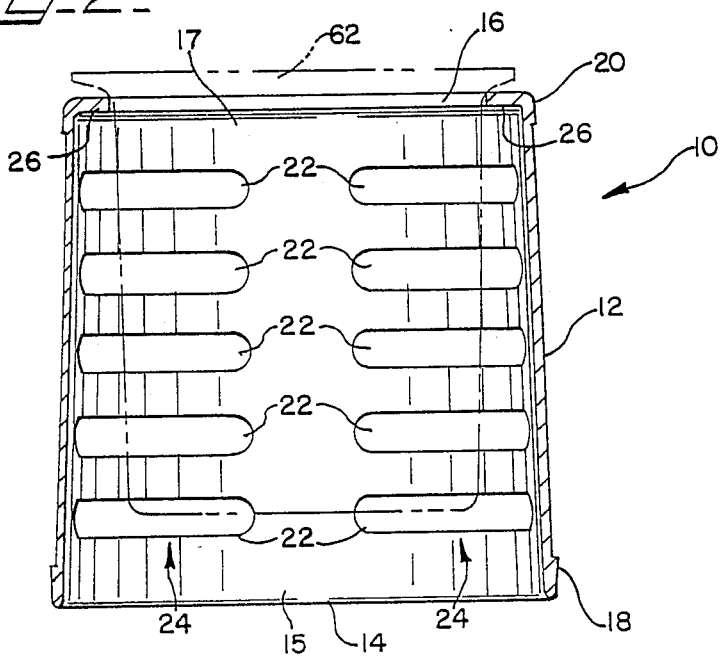
FIG. 2 is a cross-sectional inverted view of the device of FIG. 1 taken lengthwise along the device.

The shape of the ice guard 10 is also determined by the shape of the food container 62 which is received inside the ice guard 10, as is seen in phantom in FIG. 2. In the described embodiment, the ice guard 10 is round thus contemplating a round food container. Other shapes corresponding to different shaped food containers are also contemplated by the present invention.

The ice guard 10 can be formed out of any suitable material. Suitable material should be easily formed into the desired shape and be sanitary as well as non-toxic for use in the food service industry. Such satisfactory material can be a plastic suitable for injection molding such as polypropylene or any suitable thermoplastic.

The side wall 12 can include at the first end 14 a protruding portion 18 which is generally flush with the side wall 12. Such protruding portion 18 adds strength and rigidity to the first end 14 of the ice guard 10 while allowing the ice guard 10 to pull easily out of the ice.

The side wall 12 also includes at the second end 16 a rim 20. The rim 20 includes an inwardly extending or intruding portion 26. As the protruding portion 18 adds strength and rigidity to the first end 14 and still allows the ice guard 10 to be pulled easily out of the ice, so also the rim 20 adds strength and rigidity to the second end 16 while still allowing the ice guard 10 to be pulled easily out of the ice.

The intruding portion 26 acts to define the second opening 17 which is smaller than the first opening 15. Both openings are preferably circular. This makes the ice guard second opening 17 suitable for use with food containers having a smaller diameter than those used in the first opening 15. In addition, because the food container rests on the first end 14 or second end 16, different height food containers all display the food items at the same level.

In use, the ice guard 10 is placed in crushed, flaked, cubed or broken ice which surrounds all but one opening with ice. The purpose of the ice is to cool the food which is stored in the food container found inside the ice guard 10. The ice guard 10 can simply be inverted alternatively to accept different size food containers.

In order to effectuate the cooling of the food items, the ice guard 10 can include a plurality of apertures 22 defined in the side wall 12. The amount of apertured wall should be sufficient to allow ample heat transfer to adequately cool the food. The size of the apertures 22 should, however, be small enough such that the ice is not able to slide through into the interior of the ice guard 10.

In the described embodiment, sufficient heat transfer is allowed by utilizing four rows 24 of narrow, slit-like apertures 22 with each row 24 extending from the first end 14 to the second end 16. The apertures 22 can be formed by injection molding the suitable plastic in a mold which includes two retractable pieces with each including a plurality of raised members to define the apertures 22. The apertures 22 can also be cut out of a solid ice guard 10 in a post-molding step.

As an example of a suitable device, an ice guard 10 having a height of about 6.3 inches (16 cm), a wall thickness of about 0.1 inches (0.3 cm), and a first opening 15 of about 6.2 inches (15.7 cm) diameter was provided with four rows 24 of five equally spaced slit-like apertures 22. Each slit-like aperture 22 is preferably about 0.4 inches to 8 inches (1.0 cm to 2.0 cm) by 2.0 inches to 2.4 inches (5.0 cm to 6.0 cm). This provided sufficient heat transfer to adequately cool the food container while preventing ice from sliding through the apertures 22 into the interior of the ice guard 10 as well as providing ease of changing food containers and versatility of use of different size food containers simply by inverting the ice guard 10.

The second opening 17 was about 4.7 inches (12.0 cm) which was formed by an intruding portion 26 of about 0.7 inches (1.8 cm). Thus provided, the ice guard 10 can accept a food container in the first opening 15 of about 6.2 inches (15.7 cm) in diameter while the second opening 17 accepts a smaller food container of about 4.7 inches (12.0 cm) in diameter.

Figure 3:
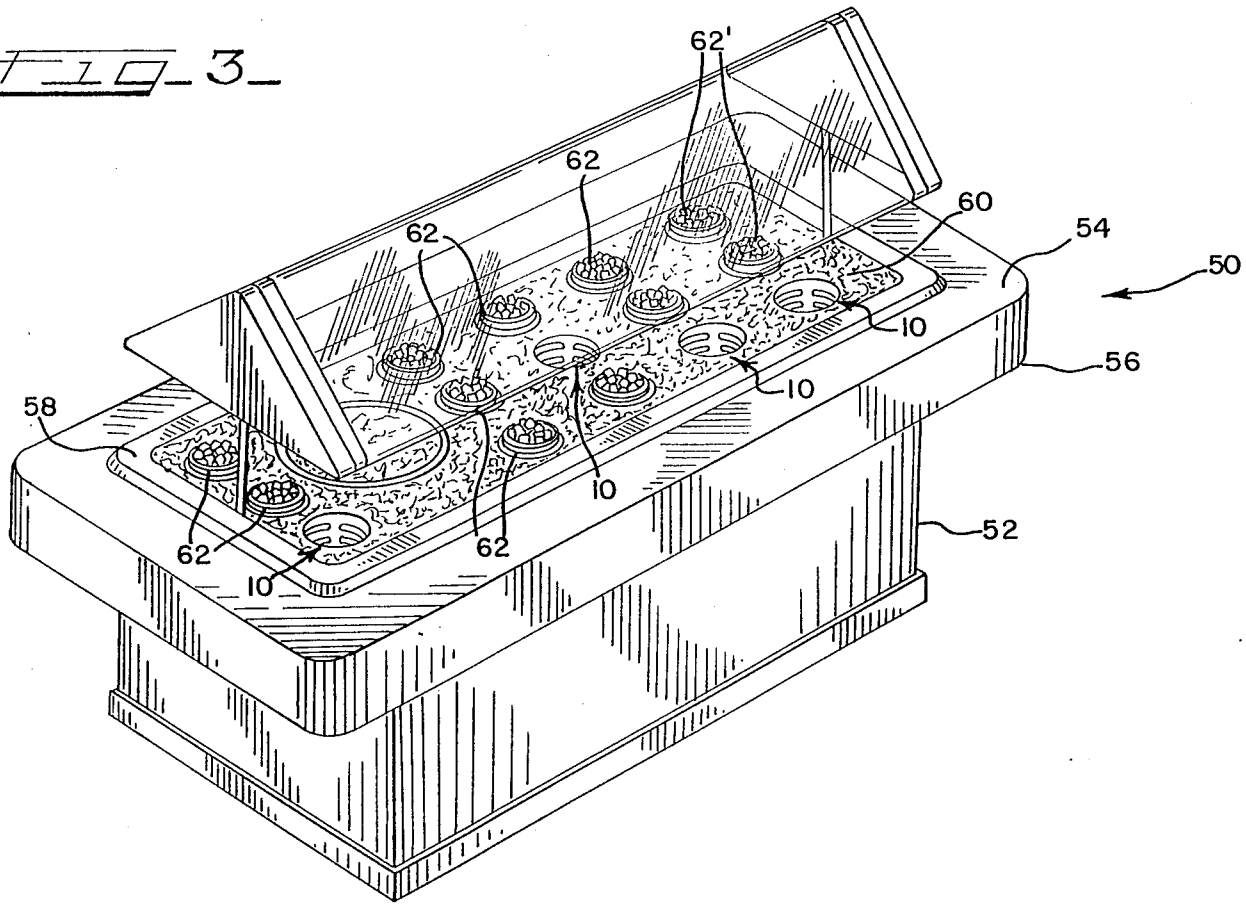
FIG. 3 is a perspective view of the device of FIG. 1 in use in a salad bar.

Referring to FIG. 3, a salad bar is designated generally by the reference numeral 50. The salad bar includes a base 52 which supports a table top 54 thereby defining a table 56. The table top 54 defines a central aperture. Contained in the central aperture is a tub portion 58 which is water tight and is made of a material suitable for food service such as stainless steel. The tub 58 also preferably includes a drain and a drain plug (neither shown) which are used to drain melted ice.

Placed in the tub 58 is an amount of ice 60 sufficient to surround all but the open top of the food containers 62. The ice 60 not only satisfactorily keeps the food items cool and therefor fresh but also provides an eye pleasing environment for the customers.

Contained in the ice 60 are the ice guards of the present invention 10. Such ice guards 10 keep the ice 60 from filling the space occupied by the food containers 62 when such food containers 62 are removed for refilling or replacement. In addition, the apertures defined in the ice guard 10 side wall 12 allow the coldness of the ice 60 to cool the food containers 62 when in place. By simple inversion, food containers of different sizes for example, 62' can be utilized, as is seen in FIG. 3.

The ice guards 10 thus help dining establishments organize their salad bar 50 by providing a quick, easy means to replace food items. The ice guard 10 is also able to accommodate different size food containers by simple inversion.

It should be understood that various modifications, changes, and variations may be made in the arrangement, operation, and details of construction of the elements disclosed herein without departing from the spirit and scope of the invention.

What is claimed is:

1. A device for reserving a place for food containers in materials such as flaked, cubed, or broken ice, comprising:

(a) a side wall defining a plurality of apertures generally in rows, the plurality of apertures being sufficient to allow ample heat transfer to cool the food container, the side wall having a first end and a second end and defining an interior space, the first end defining an opening adapted to receive a first size of food container through the first opening and into the interior space; and (b) a rim mounted on the second end of the side wall and extending inwardly of the side wall, the rim defining a second opening adapted to receive a second, smaller, size of food container through the second opening and into the interior space.

2. The device of claim 1 wherein the plurality of apertures comprise a plurality of slits.

3. The device of claim 1 wherein the plurality of apertures are small enough such that the crushed, flaked, cubed, or broken ice is substantially prevented from sliding into the interior space.

4. The device of claim 3 wherein the apertures are between about 0.4 inches to 0.8 inches wide by 2.0 inches to 2.4 inches long.

5. The device of claim 1 wherein the first end includes a generally flush protruding section about the circumference of the first end.

6. A device for reserving a place for food containers in materials such as crushed, flaked, cubed, or broken ice, comprising:

a side wall defining a plurality of apertures, the plurality of apertures having the general configuration of rowed slits, the side wall having a first end and a second end and defining an interior space, the first end being adapted to receive a first size of food container into the interior space and the second end having a rim extending inwardly of the side wall, the rim being adapted to receive a second, smaller, size of food container, the device being able to utilize either the first end or the second end by inverting the device in the crushed, flaked, cubed, or broken ice.

7. The device of claim 6 wherein the plurality of apertures are small enough such that the crushed, flaked, cubed, or broken ice is substantially prevented from sliding into the interior space.

8. The device of claim 6 wherein the number of apertures is sufficient to allow ample heat transfer to cool the food container.

9. The device of claim 6 wherein the side wall is generally cylindrical.

10. A salad bar having a choice of self-serve food items in food containers, comprising:

a table;

a tub contained in the table;

crushed, flaked, cubed, or broken ice contained in the tub; and at least one ice guard in the crushed, flaked, cubed, or broken ice to reserve a place for a food container, the ice guard having a side wall, the side wall having a first end and a second end and defining an interior space, the first end defining an opening adapted to receive a first size of food container and the second end defining a second opening adapted to receive a second, smaller, sized food container.

11. The device of claim 10 wherein the ice guard second end further includes a rim extending inwardly of the side wall, the rim defining the second opening.

12. The device of claim 10 wherein the ice guard side wall defines a plurality of apertures.

13. The device of claim 12 wherein the plurality of apertures comprise a plurality of rowed slits.

14. The device of claim 12 wherein the plurality of apertures are small enough such that the crushed, flaked, cubed, or broken ice is substantially prevented from sliding into the interior space.

15. The device of claim 12 wherein the number of apertures is sufficient to allow ample heat transfer to cool the food container.

16. A device for reserving a place for food containers in materials such as flaked, cubed, or broken ice, comprising:

(a) a side wall defining a plurality of apertures being small enough to substantially prevent crushed, flaked, cubed, or broken ice from sliding into the interior space, the dimensions of the apertures being between about 0.4 inched to about 0.8 inches wide and about 2.0 inches to about 2.4 inches long, the side wall having a first end and a second end defining an interior space, the first end defining an opening adapted to receive a first size of food container through the first opening and into the interior space; and (b) a rim mounted on the second end of the side wall and extending inwardly of the side wall, the rim defining a second opening adapted to receive a second, smaller, size of food container through the second opening and into the interior space.

* * * * *

UNITED STATES PATENT AND TRADEMARK OFFICE

CERTIFICATE OF CORRECTION

PATENT NO. : 4,923,086

DATED : May 8, 1990

INVENTOR(S) : Terrence K. Mahon and Daniel A. Matre

It is certified that error appears in the above-identified patent and that said Letters Patent is hereby corrected as shown below:

Col. 3, line 31, change "8 inches" to --.8 inches--

Claim 16, col. 6, line 11, change "inched" to --inches--

Signed and Sealed this

Twenty-fourth Day of September, 1991

*Attest:*

HARRY F. MANBECK, JR.

*Attesting Officer*

*Commissioner of Patents and Trademarks*